US005324194A

United States Patent [19]

Bruce et al.

[11] Patent Number: 5,324,194

[45] Date of Patent: Jun. 28, 1994

[54] SNAP-IN HOT SURFACE IGNITOR BRACKET

[75] Inventors: Thomas P. Bruce, Columbus; Matthew Kujawa, Danville; Robert C. Swilik, Jr., Indianapolis, all of Ind.

[73] Assignee: Carrier Corporation, Syracuse, N.Y.

[21] Appl. No.: 92,398

[22] Filed: Jul. 15, 1993

[51] Int. Cl.[5] ..... F23Q 7/06

[52] U.S. Cl. ..... 431/258; 431/263; 126/99 R; 126/116 R

[58] Field of Search ..... 126/99 R, 116 R, 116 A, 126/110 R; 248/27.1, 27.3; 431/254, 255, 258-266; 439/557

[56] References Cited

U.S. PATENT DOCUMENTS

| | | | |
|---|---|---|---|
| 2,966,942 | 1/1961 | Breese et al. | 431/262 |
| 4,462,790 | 7/1984 | Hansen | 431/258 |
| 4,464,107 | 8/1984 | Boe | 431/264 |
| 4,622,811 | 11/1986 | Distel et al. | 431/258 |
| 4,846,716 | 7/1989 | Courrege | 431/263 |
| 5,238,426 | 8/1993 | Arnett | 248/27.3 |

*Primary Examiner*—James C. Yeung

[57] ABSTRACT

A bracket for a hot surface ignitor is provided with a central opening having downwardly directed supporting arms and upwardly directed L-shaped retention arms such that the ignitor can be lockingly engaged with the bracket without creating crack-inducing stresses in the ceramic base of the ignitor. The bracket is further provided with upwardly directed resilient detents that allow the bracket to be securely snapped into the burner box of a gas furnace. The bracket thus positions the hot surface portion of the ignitor within the burner box while positioning the ceramic base and electric supply wires exterior to the box.

13 Claims, 3 Drawing Sheets

SNAP-IN HOT SURFACE IGNITOR BRACKET

BACKGROUND OF THE INVENTION

1. Field of the Invention

This invention relates in general to hot surface ignitors used in gas furnaces having burner boxes and, in particular, to a snap-in bracket for receiving the hot surface ignitor and positioning it relative to the burner box of the furnace.

2. Discussion of the Prior Art

The residential heating industry has benefitted from the advent of hot surface ignitors. Such ignitors are used in gas furnaces to ignite the gas as it exits combustion burners provided in a burner box. The hot surface ignitors are an advancement over the lit gas pilot lights used in older furnaces to ignite the primary flow of gas for heating.

Hot surface ignitors typically include a silicon oxide resistance portion cemented in a ceramic base. Electric wires are connected to the ceramic base to provide electric current to the silicon oxide resistance portion. Current supplied to the resistance portion is converted to heat that produces a red hot glow in the silicon oxide. In this condition, the hot surface ignitor is enabled to ignite the gas exiting the combustion burners.

In typical gas furnaces, gas is supplied to the furnace by a gas manifold. The manifold is provided with jets that direct the gas into burners contained in a burner box. The gas is ignited as it exits the burners contained in the burner box. The heated flue gas produced by combustion of the gas is then directed into a heat exchanger. The heated flue gas is induced to move through the heat exchanger while a blower moves clean circulating air over the heat exchanger. The heated air thus produced is directed to desired locations by a system of ducts and registers.

Prior gas furnaces utilizing hot surface ignitors secure the ignitor within the burner box by means of a sheet metal screw. A hole would be provided through the ceramic base of the igniter to receive the screw. During installation of the ignitor in the burner box, this mounting screw could be tightened to the point of creating crack-inducing stresses within the ceramic base portion of the ignitor. In addition, this method of installation resulted in exposing the entire ceramic base and electric supply wires to the relatively high temperatures maintained within the burner box during combustion.

OBJECTS AND SUMMARY OF THE INVENTION

It is, therefore, an object of the present invention to improve gas furnaces utilizing hot surface ignitors.

A further object of the present invention is to enable the ceramic base portion of a hot surface ignitor to be securely received in a bracket and positioned relative to the burner box of a gas furnace without creating crack-inducing stresses in the ceramic base portion.

Still another object of the present invention is to position the silicon oxide resistent portion of a hot surface ignitor within the burner box of a gas furnace while positioning the ceramic base portion and connecting electrical wires of the ignitor exterior to the burner box.

Yet another object of the present invention is to enable a hot surface ignitor to be securely and quickly installed on the burner box of a gas furnace and easily removed therefrom for inspection and replacement.

These and other objects are attained in accordance with the present invention wherein there is provided a bracket formed of sheet metal having a base segment with a rectangular central opening formed therein. Two pair of outwardly opposed and upwardly directed resilient detents are provided on opposite edges of the base segment, while two flexible downwardly directed supporting arms are provided on opposite edges of the central rectangular opening. Each of the supporting arms include a pair of inwardly directed barbed detents. The base segment of the bracket also includes two upwardly directed L-shaped retention arms. Each of these arms is formed on opposite edges of the rectangular central opening in the base member and is substantially co-planar with each of the downwardly directed supporting arms.

The hot surface ignitor utilized in conjunction with the snap-in bracket of the present invention is of the type that has a silicon oxide resistance portion capable of converting electric current into heat. This resistance portion is secured in a ceramic base portion which has electrical wires connected thereto to provide electric current to the silicon oxide resistance portion of the hot surface ignitor. The ceramic base of the hot surface ignitor is rectangular in cross-section and fits closely within the rectangular opening provided in the base segment of the snap-in bracket. The ceramic base portion of the hot surface ignitor also includes a smooth rectangular bottom surface. In accordance with one aspect of the present invention, when the ceramic base section of the hot surface ignitor is inserted into the rectangular central opening from beneath the base segment, the downwardly directed supporting arms will flex slightly outwardly until the barbed detents on the arms snap under the bottom surface of the ceramic base. The upwardly directed L-shaped retention arms provided on the bracket will prevent the ceramic base portion of the hot surface ignitor from further movement relative to the bracket. In this manner, the hot surface ignitor is securely received in the snap-in bracket without creating crack-inducing stresses in the ceramic base portion. The silicon oxide portion of the hot surface ignitor can thus be securely positioned within the burner box of the furnace.

The bracket of the present invention is intended to be employed in furnaces that include a burner box containing combustion burners. In accordance with another aspect of the present invention, the burner box is provided with a rectangular opening formed therein to receive the silicon oxide portion of the ignitor and the resilient detents of the bracket of the present invention. The four upwardly directed resilient detents of the bracket are formed to correspond to the four corners of the rectangular opening provided in the burner box. In this manner, when the detents are placed in register with the corners, the bracket may be securely snapped into the burner box. This positions the silicon resistance portion of the ignitor within the box between the discharge side of the burner and the inlet side of the heat exchanger while the ceramic base portion and electric wires connected thereto are advantageously positioned exterior to the burner box.

BRIEF DESCRIPTION OF THE DRAWING

Further objects of the present invention together with additional features contributing thereto and advantages accruing therefrom will be apparent from the following description of the preferred embodiment of the invention which is shown in the accompanying drawing with like elements having the same reference numeral, wherein.

DETAILED DESCRIPTION OF A PREFERRED EMBODIMENT

Figure 1:
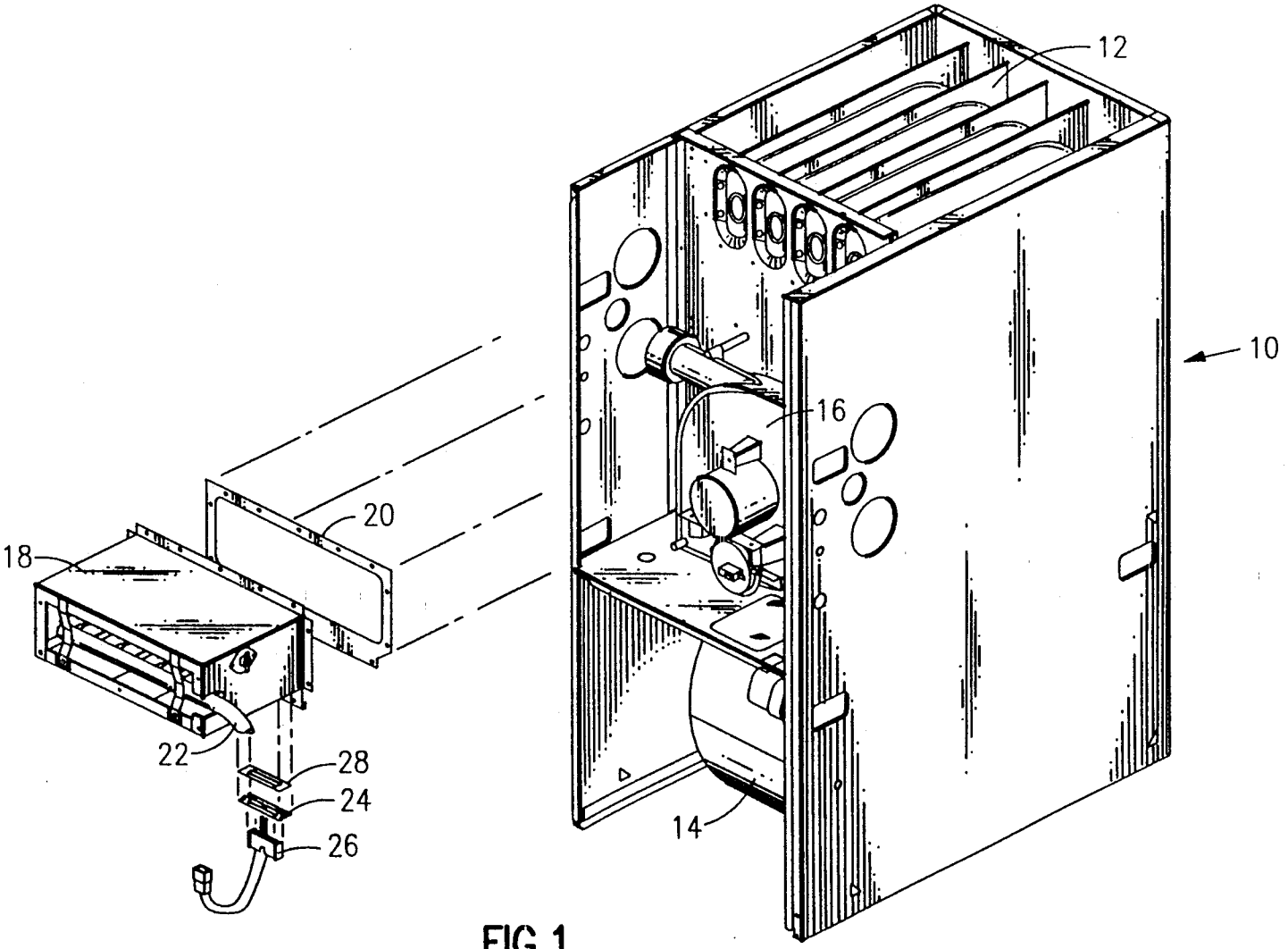
FIG. 1 is an exploded perspective view of a gas furnace having a burner box employing the snap-in bracket of the present invention.

Referring now to FIG. 1 there is shown a gas furnace generally referenced 10. The gas furnace 10 includes a heat exchanger 12, a blower 14 and an inducer 16. The inducer 16 induces flow of flue gas through the heat exchanger 12. As the flue gas passes through the heat exchanger 12, the blower 14 provides a flow of clear intake air over the heat exchanger 12, thus producing heated air that may be directed to desired locations by a system of duct work and registers.

The gas furnace 10 also includes a burner box 18 which is supplied gas via a gas manifold 22. The burner box 18 including the gas manifold 22 is secured to the inlet side of the heat exchanger 12 by fastening means such as sheet metal screws. A burner box gasket 20 is provided between the inlet side of the heat exchanger 12 and the burner box. Also shown in FIG. 1 is a bracket 24 in accordance with the present invention, a hot surface ignitor 26, and a bracket gasket 28.

Figure 2:
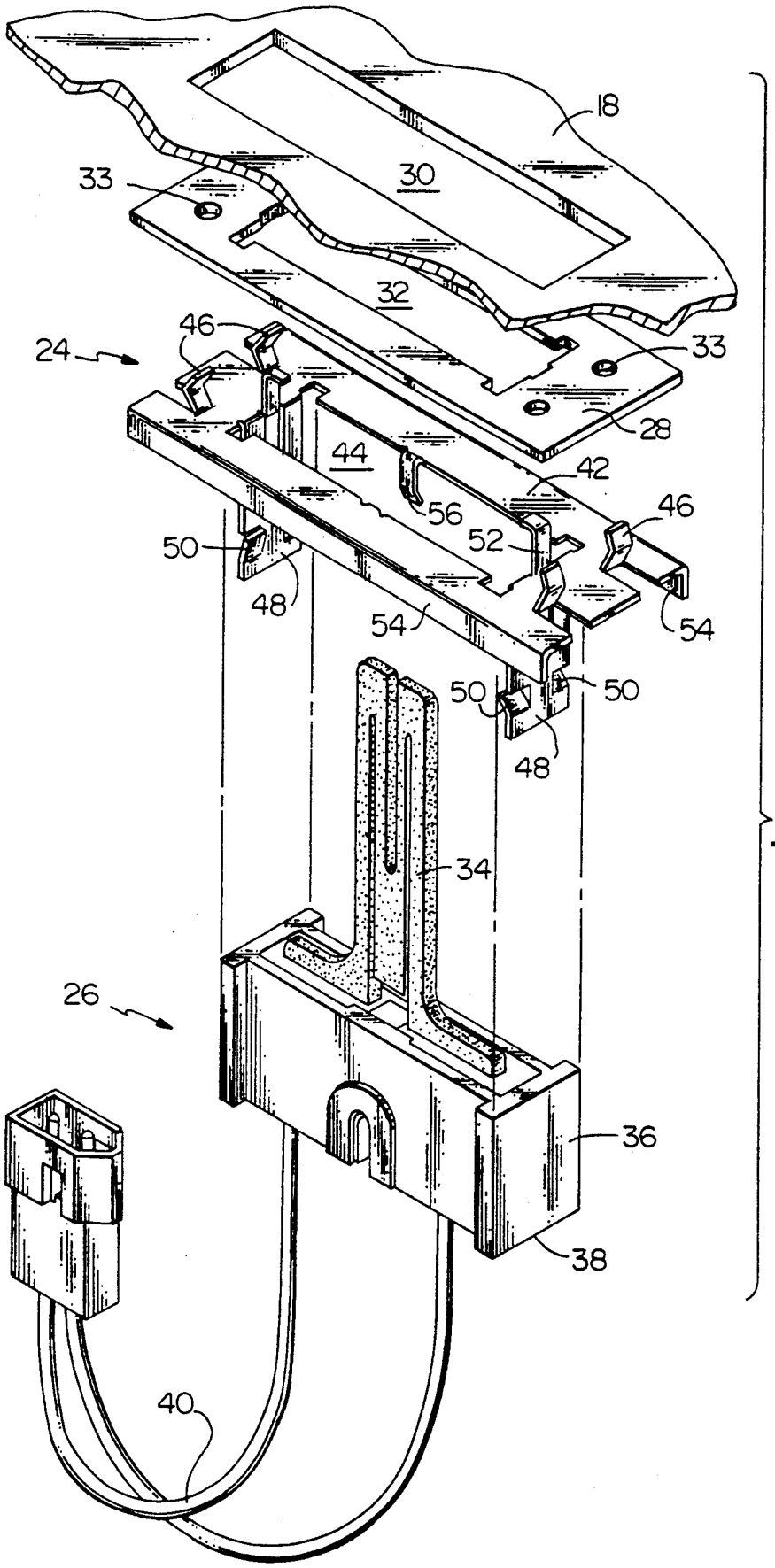
FIG. 2 is an enlarged exploded perspective view of the bracket of the present invention shown disassociated from the hot surface ignitor and burner box of FIG. 1.

FIG. 2 shows in greater detail the snap-in bracket 24, the hot surface ignitor 26, the bracket gasket 28 and a broken away portion of the burner box 18. The burner box 18 includes a rectangular opening 30 while the bracket gasket 28 includes a corresponding rectangular opening 32. The hot surface ignitor 26 shown in FIG. 2 includes a hot surface resistance portion 34. The hot surface portion 34 of the ignitor 26 is cemented in a ceramic base 36 that includes a bottom surface 38. The ceramic base 36 also includes electric wires 40 that are electrically connected to the hot surface portion 34 to provide electric current thereto. The hot surface portion 34 is preferably composed of silicon oxide so that it may be repeatedly heated to a red hot glow to ignite gas for combustion supplied to the furnace 10 by gas manifold 22.

The snap-in bracket 24 includes a rectangular base segment 42 which includes a rectangular central opening 44 that corresponds to the opening 32 in the bracket gasket 28 as well as the opening 30 in the burner box 18. The base segment 42 of the bracket 24 includes two pair of outwardly opposed and upwardly directed resilient detents 46—46, each of which has a crimped, C-shaped configuration. Each pair of detents 46—46 is formed approximate to one of the opposed shorter sides of the rectangular base segment 42 as shown in FIG. 2. The bracket 24 is also provided with two flexible downwardly directed supporting arms 48. Each of the arms 48 includes a pair of inwardly directed barbed detents 50—50. The rectangular central opening 44 of the bracket 24 is further provided with a pair of L-shaped retention arms 52 that are upwardly directed relative to the base segment 42. A reinforcing rib 54 is formed on each of the opposed longer sides of the rectangular base segment 42 to give the bracket 24 greater strength. Also shown in FIG. 2 are lateral support tabs 56.

Upon assembly of the hot surface ignitor 26 with the burner box 18, the ceramic base portion 36 is inserted into the central opening 44 of the bracket 24 from beneath the base segment 42. As this is done, the downwardly directed supporting arms 48 will flex slightly outwardly until the barb detents 50—50 snap under the bottom surface 38. At this point, the L-shaped retention arms will prevent further movement of the hot surface ignitor 26 relative to the bracket 24. During this assembly, the lateral support tabs 56 will align and guide the ceramic base 36 into the central opening 44. Once the ignitor 26 is snapped into place and secured between the barbed detents 50—50 and the L-shaped retention arms 52, the supporting tabs 56 provide additional lateral support of the ceramic base 36 relative to the bracket 24. The gasket 28 is then positioned on top of the bracket 24 with the resilient detents projecting through holes 33 provided therein. In this condition, the bracket 24 and the hot surface ignitor 26 are assembled and ready to be secured within the opening 30 of the burner box 18. This is accomplished by placing the resilient detents 46 in register with the corners of the opening 30. In this position, the bracket and hot surface ignitor assembly may be securely snapped into the opening 30.

Figure 3:
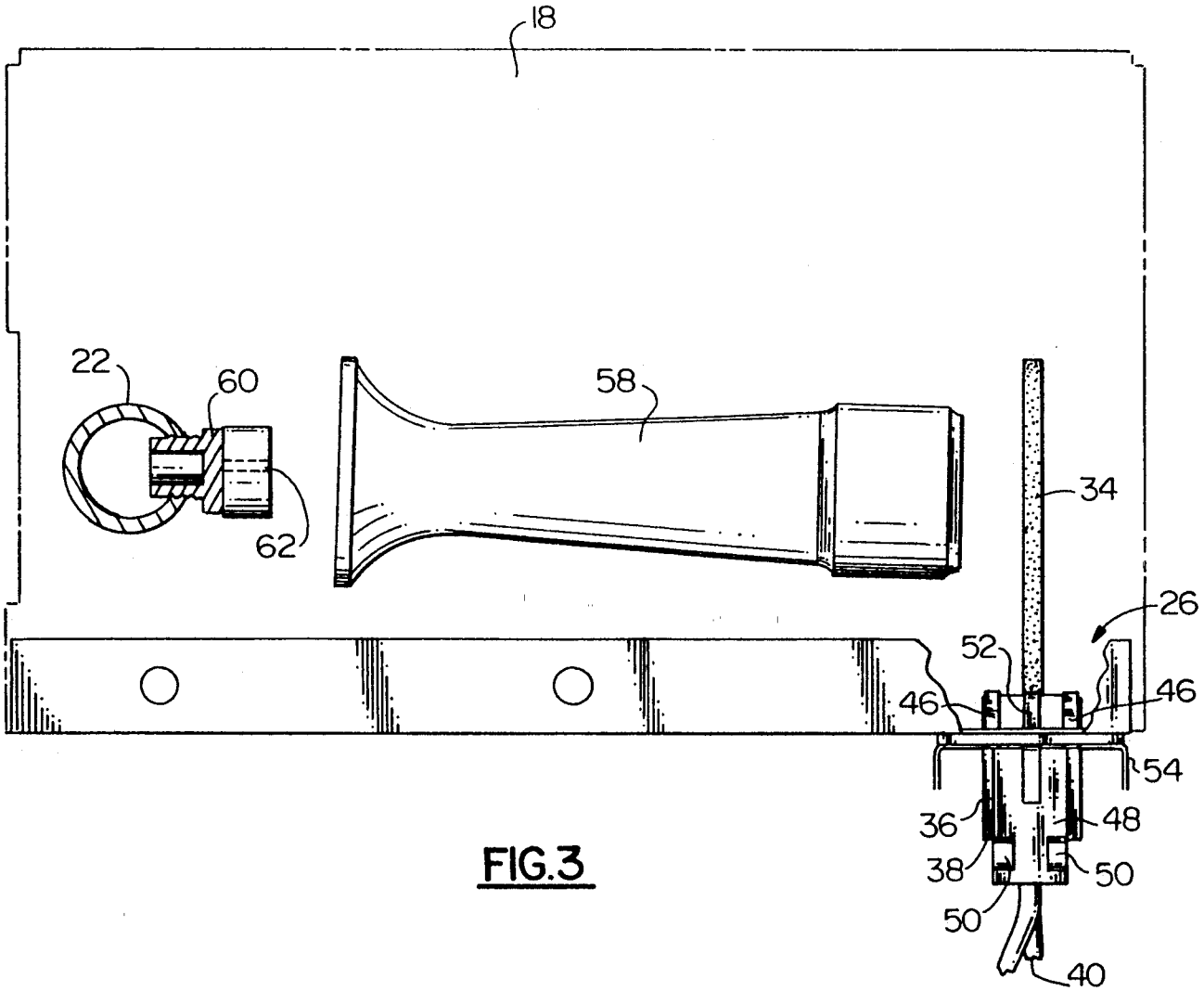
FIG. 3 is a side elevational view partially broken away showing the placement of the hot surface ignitor in relation to the gas manifold and burners contained in the burner box of the gas furnace of FIG. 1.

Referring now to FIG. 3, there is shown the hot surface ignitor 26 advantageously positioned within the burner box 18. The burner box 18 includes at least one burner 58 positioned between the hot surface portion 34 of the ignitor 26 and the gas manifold 22 as shown in FIG. 3. The gas furnace 10 shown in FIG. 1 includes four burners 58 each corresponding to one of the panels comprising the heat exchanger 12. Irrespective of the number of burners 58 utilized in the typical gas furnace 10, only one hot surface ignitor 26 and thus one bracket 24, is required.

For each burner 58 the gas manifold 22 includes a threaded jet plug 60 provided with an orifice 62 to direct the flow of incoming gas into the inlet side of the burners 58. As the gas exits the discharge side of the burner 58, the hot surface ignitor will ignite the gas. Typically, the velocity of the gas traveling through the burner 58 is greater than the flame velocity of the ignited gas so that the flame will extend only partially into each burner 58. The flue gas thus produced by combustion is directed into the heat exchanger 12 as shown in FIG. 1.

During the life of the furnace 10, it may be necessary to service the furnace and the hot surface ignitor of the furnace. When this becomes necessary the bracket 24 may be easily removed from the burner box 18 by placing a flat screwdriver between the bracket 24 and the burner box 18 and prying the bracket away therefrom. In this manner, the hot surface ignitor may be easily inspected and replaced if necessary. In accordance with one aspect of the present invention, when the ceramic base portion 36 of the ignitor 26 is snapped into the supporting arms 48 of bracket 24, it is secured by the L-shaped retention arms 52 and the barbed detents 50—50 without the creation of any crack inducing stress in the ceramic base portion 36. In accordance with another aspect of the present invention, substantially all of the ceramic base portion as well as the electric wires 40 connected thereto are advantageously positioned exterior to the burner box 18. This advantageous placement of the ceramic base portion 26 and the electric wires 40 results in greater service life of these elements since they are not continuously exposed to the higher temperatures maintained within the burner box 18 during operation of the furnace.

While this invention has been described in detail with reference to a certain preferred embodiment, it should be appreciated that the present invention is not limited to that precise embodiment. Rather, in view of the present disclosure, many modifications and variations would present themselves to those of skill in the art without departing from the scope and spirit of this invention, as defined in the appended claims.

What is claimed is:

1. In a furnace of the type having burners for combusting a gas exiting from a manifold and for directing the resultant heat into a heat exchanger, the combination comprising:

a burner box for housing the burners, said burner box having an opening formed therein;

ignition means for combusting the gas upon exit from the burners; and bracket means for securely receiving and positioning said ignition means in a predetermined location so that the gas is combusted upon exit from the burners, wherein said bracket means includes:

a base segment having a central opening;

at least two outwardly opposed and upwardly directed resilient detents each being formed proximate to opposite edges of said base segment;

two flexible downwardly directed supporting arms, each having a pair of inwardly directed barbed detents, each of the supporting arms being formed on opposite edges of said central opening; and at least two L-shaped upwardly directed retention arms each formed on opposite edges of said central opening, each of the arms being substantially coplanar with one of said downwardly directed supporting arms;

whereby when said hot surface ignitor is inserted into said central opening from beneath said base segment, said downwardly directed supporting arms will flex slightly outwardly until said barbed detents snap under said bottom surface of said ceramic base portion and said L-shaped retention arms will prevent further movement of the ignitor relative to said bracket means.

2. The combination according to claim 1 wherein said ignition means includes a hot surface ignitor having:

a silicon oxide resistance portion capable of converting electric current into heat and being positioned between the burners and heat exchanger to ignite the gas for combustion; and a ceramic base portion for supporting said silicon oxide resistance portion and electrical wires that supply current thereto, said ceramic base having a bottom surface that allows said hot surface ignitor to be lockingly engaged with said bracket means.

3. The combination according to claim 2 wherein said burner box opening is rectangular in shape and said bracket means includes four upwardly directed resilient detents, each being positioned on the base segment to correspond to one of the corners of the rectangular opening in said burner box so that when the resilient detents are in register with said corners, said bracket means may be securely snapped into the burner box whereby said silicon oxide resistance portion of the ignitor is positioned within the box and said ceramic base portion and electrical wires are positioned exterior to the burner box.

4. The combination according to claim 3 wherein said central opening in said bracket means is rectangular in shape and said ceramic base portion of the ignitor is correspondingly shaped to fit closely therein.

5. The combination according to claim 4 wherein said base segment of said bracket means is rectangular in shape, formed from sheet metal, and further includes downwardly directed reinforcing ribs formed on opposite sides thereof and downwardly directed lateral support tabs formed on opposite edges of the rectangular central opening for aligning and supporting the ceramic base of the ignitor.

6. An ignition assembly for initiating combustion of a gas supplied by a manifold in a furnace having burners for directing heat into a heat exchanger, comprising:

a burner box for housing the burners, said burner box having an opening formed therein;

a hot surface ignitor having a silicon oxide resistance portion capable of converting electric current into heat and a ceramic base portion for supporting the resistance portion and electric wires that supply current thereto;

bracket means for securely engaging said ceramic base portion without creating crack-inducing stress therein, and for securely engaging the opening in said burner box so that said silicon oxide resistance portion is positioned within the box between the burners and heat exchanger while the ceramic base and electric wires are positioned exterior to said burner box; wherein said bracket means includes:

a base segment having a central opening formed therein;

at least two outwardly opposed and upwardly directed resilient detents each being formed proximate to opposite edges of said base segment;

two flexible downwardly directed supporting arms each having a pair of inwardly directed barbed detents, each of the supporting arms being formed on opposite edges of said central opening in the base; and at least two L-shaped upwardly directed retention arms each formed on opposite edges of said central opening, each of the retention arms being substantially co-planar with one of said downwardly directed supporting arms;

whereby when said hot surface ignitor is inserted into said central opening from beneath said base segment, said downwardly directed supporting arms will flex slightly outwardly until said barbed detents snap under a bottom surface of the ceramic base and said L-shaped retention arms will prevent further movement of the ignitor relative to said bracket means.

7. The ignition assembly according to claim 6 wherein said burner box opening is rectangular in shape and said bracket means includes four upwardly directed resilient detents each being positioned on the base segment to correspond to one of the corners of the rectangular opening in said burner box so that when the resilient detents are in register with said corners, said bracket means may be securely snapped into the burner box whereby said silicon oxide resistance portion of the ignitor is positioned within the box and said ceramic base portion and electrical wires are positioned exterior to the burner box.

8. The ignition assembly according to claim 7 wherein said central opening in said bracket means is rectangular in shape and said ceramic base portion of the ignitor is correspondingly shaped to fit closely therein.

9. The ignition assembly according to claim 8 wherein said base segment of said bracket means is rectangular in shape, formed from sheet metal, and further includes downwardly directed reinforcing ribs formed on opposite sides of the base and downwardly directed lateral support tabs formed on opposite edges of the rectangular central opening for aligning and supporting the ceramic base of the ignitor.

10. A bracket for an ignitor in a furnace having a gas manifold and combustion burners positioned in a burner box with an opening provided therein, the burners for directing heat into a heat exchanger and the ignitor being of the hot surface type having a silicon oxide resistance portion and a ceramic base portion with a bottom surface, the ceramic base for supporting the silicon oxide portion and electrical wires that supply current thereto, the bracket comprising:

a base segment having a central opening formed therein;

at least two outwardly opposed and upwardly directed resilient detents each being formed proximate to opposite edges of said base segment;

two flexible downwardly directed supporting arms each having a pair of inwardly directed barbed detents, each of the supporting arms being formed on opposite edges of said central opening in the base; and at least two L-shaped upwardly directed retention arms each formed on opposite edges of said central opening, each of the retention arms being substantially co-planar with one of said downwardly directed supporting arms;

whereby when the hot surface ignitor is inserted into said central opening from beneath said base segment, said downwardly directed supporting arms will flex slightly outwardly until said barbed detents snap under said bottom surface of the ceramic base and said L-shaped retention arms will prevent further movement of the ignitor relative to the bracket.

11. The bracket according to claim 10 wherein the burner box opening is rectangular in shape and the bracket includes four upwardly directed resilient detents, each being positioned on said base segment to correspond to one of the corners of the rectangular opening in the burner box so that when the resilient detents are in register with said corners, the bracket may be securely snapped into the burner box whereby the silicon oxide portion of the ignitor is positioned within the box and the ceramic base portion and electrical wires are positioned exterior to the burner box.

12. The bracket according to claim 11 wherein said central opening in the bracket is rectangular in shape and the ceramic base portion of the ignitor is correspondingly shaped to fit closely therein.

13. The bracket according to claim 12 wherein said base segment of the bracket is rectangular in shape, formed from sheet metal, and further includes downwardly directed reinforcing ribs formed on opposite sides thereof and downwardly directed lateral support tabs formed on opposite edges of the rectangular central opening for aligning and supporting the ceramic base of the ignitor therein.

* * * * *